United States Patent [19]

Hultholm et al.

[11] Patent Number: 4,565,660

[45] Date of Patent: Jan. 21, 1986

[54] METHOD FOR DISPERSING GAS, FOR MIXING A PULVEROUS SOLID INTO A LIQUID TO FORM A SUSPENSION, AND FOR MAINTAINING THE OBTAINED GOOD SOLID-GAS-LIQUID SUSPENSION IN THE REACTOR

[75] Inventors: Stig-Erik Hultholm; Launo L. Lilja; Valto J. Mäkitalo, all of Pori; Bror G. Nyman, Vanha-Ulvila, all of Finland

[73] Assignee: Outokumpu Oy, Outokumpu, Finland

[21] Appl. No.: 523,732

[22] Filed: Aug. 16, 1983

[30] Foreign Application Priority Data

Aug. 24, 1982 [FI] Finland ..... 822937

[51] Int. Cl.[4] ..... B01F 3/04

[52] U.S. Cl. ..... 261/121 R; 366/101; 366/106; 422/231

[58] Field of Search ..... 261/121 R, 124, 1, 81; 210/221.2; 422/231; 239/450; 209/170; 366/101, 106, 102, 103

[56] References Cited

U.S. PATENT DOCUMENTS

| | | | |
|---|---|---|---|
| 2,383,946 | 9/1945 | Tietig | 422/231 X |
| 2,805,846 | 9/1957 | Dewan | 261/121 R |
| 3,587,972 | 6/1971 | Weeth | 239/450 X |
| 3,606,999 | 9/1971 | Lawless | 422/231 X |
| 4,182,617 | 1/1980 | Al-Saidi | 261/124 X |
| 4,215,082 | 7/1980 | Danel | 261/124 |
| 4,230,569 | 10/1980 | Lohrberg et al. | 261/121 R X |
| 4,302,406 | 11/1981 | Van Heel | 261/124 |
| 4,304,740 | 12/1981 | Cernoch | 261/124 X |

*Primary Examiner*—Richard L. Chiesa

*Attorney, Agent, or Firm*—Bucknam and Archer

[57] ABSTRACT

A certain amount of gas is directed under the liquid surface in a solution reactor, advantageously into the bottom of the reactor, for dispersing the gas into small bubbles and distributing it as evenly as possible over the entire cross-sectional area of the reactor. When the gas discharges and disperses from a flexible-structured member, the reaction force produced by the discharging gas imparts to the dispersing member a whip-like movement having a continuously decreasing radius of curvature. This movement produces strong mechanical mixing in the liquid. This is further enhanced by the strong gas jet discharging from the end of the dispersing member and changing its place randomly. Due to the resultant strong mixing, the solid in the reactor remains in motion and continuously maintains the good degree of suspension and does not accumulate in piles on the bottom of the reactor. Depending on the amount of the gas, the rising gas bubbles produce in the reactor effective vertical flows which further mix the solid.

6 Claims, 3 Drawing Figures

METHOD FOR DISPERSING GAS, FOR MIXING A PULVEROUS SOLID INTO A LIQUID TO FORM A SUSPENSION, AND FOR MAINTAINING THE OBTAINED GOOD SOLID-GAS-LIQUID SUSPENSION IN THE REACTOR

BACKGROUND OF THE INVENTION

The present invention relates to a method for directing a certain amount of gas below the liquid surface in a solution reactor. More particularly, the invention relates to a method for directing a certain amount of gas to the bottom of a solution reactor, below the liquid surface.

The direction of the gas to the bottom of the reactor results in the dispersement of the gas into small bubbles, and the distribution of the gas as evenly as possible over the entire cross-sectional area of the reactor. When the gas discharges and disperses from the flexible-structured member in accordance with the invention, the reaction force due to the discharge puts the dispersion member into a whip-like movement which has a continuously decreasing radius of curvature. This movement cause a strong mechanical mixing in the liquid. This mixing is further enhanced by the strong gas jet discharging from the end of the dispersing member and changing place randomly. Due to this strong agitation, the solid in the reactor remains in motion and continuously maintains the produced good degree of suspension and does not accumulate into piles on the bottom of the reactor. Depending on the amount of gas, the rising gas bubbles produce effective vertical flows in the reactor which further mix the solid.

There are good and practical methods for mixing a pulverulent solid into a liquid to form a good suspension, or for dispersing a gas into a liquid. These methods have been described in the literature in, for example, Ullmanns "Encyclopädie der technischen Chemie", Band 2, pp. 260–281. the following references are to this work.

One example of apparatus for the mixing of a pulverulent solid into a liquid is a simple so-called pitch-blade mixer having a blade angle of 45° (Ullmann, page 261, Abb 3, g) having a depressing effect. This produces a flow which is downward at the center of the reactor and upward along its sides, simultaneously producing turbulence important for reactions.

The following are standard methods for dispersing gas in a liquid. One device consists of a

- nozzle or several nozzles from which the gas discharges, thereby forming small bubbles. Another device is
- a turbine mixer (Ullmann, page 261, Abb. 3, a) having vertical blades, in which gas directed under the mixer comes within the area of influence of the mixer and is dispersed into bubbles which are smaller, the greater the power used in the turbine.
- Gas is also dispersed via the use of so-called self-suction cross-pipes (Ullmann, Page 276, Abb. 19). That is the gas space branches out from the lower end of a hollow shaft, most commonly into four pipes, which are open at their tips. Due to the underpressure produced in the gas space by the rotating cross-pipe, the gas is discharged and dispersed into bubbles in the solution space in the reactor. It should be noted that when the temperature of the solution rises, the vapor pressure also rises, whereby the effect of the underpressure decreases.

However, the matter becomes more complicated when it is necessary to simultaneously disperse a gas effectively into small bubbles and, in addition, to maintain a pulverulent solid in good suspension in a liquid. None of the aforedescribed methods is capable of simultaneously satisfying both the requirements for dispersion and the maintenance of the suspension, sufficiently well, especially if the solid is coarse-grained and the density of the slurry is high.

In all cases, with the exception of nozzle methods, there are further difficulties when the solution level rises, since the mixing shaft has its own length limitations.

The object of the present invention is to direct gas into a solution reactor, preferably its lower part, to disperse it into small bubbles, and to distribute it as evenly as possible over the entire cross-sectional area of the reactor and to simultaneously form as good a suspension as possible of a pulverulent solid in a liquid and to maintain such suspension and to keep the solid in a strong turbulent motion.

SUMMARY OF THE INVENTION

When a three-phase system of pulverulent solid, liquid and gas is involved, performances of different types are required of the gas-dispersing member. The gas dispersing member must disperse the gas, distribute the formed gas bubbles over the entire cross-sectional area of the reactor, bring the solid particles into motion, and maintain the suspension thus formed.

It is known that the turbulence of a flow controls the transfer of mass and heat from a bubble and the degree of dispersion of a gas. It is also known that the vortices affecting turbulence are at their largest at their point of formation. In mixers, it is close to the tips of the blades, at nozzles in the vicinity of the discharge outlet, etc. At this point, their wavelengths or scales are of the same order of magnitude as are those of the main flow. However, large vortices are unstable, and they gradually break down into smaller vortices until, due to a viscous flow, their energy is finally converted entirely to heat.

The forces regulating the size of a bubble are shear stress and surface tension. Shear stress is dependent on the force of the turbulence, which, for its part, is dependent, as stated above, on the vicinity of the motion-producing device and, of course, also on its efficiency such as, for example, velocity, etc.

It is thus advantageous to produce a sufficient turbulence velocity as close as possible to the gas-feeding point, which is at, for example, a nozzle discharge outlet. Even more advantageously, the gas-feeding point is in so-called hollow self-suction cross-pipes, in which, in addition to the gas discharge velocity, the peripheral velocity of the mixer end itself is also effective. This same effect of peripheral velocity also appears in radial turbines, in which gas is fed directly under the blades. In both mixers, the rotational motion further produces an area of underpressure behind the blade, enhancing the dispersion of the flow.

In fixed nozzles, the dispersion area is primarily pointlike. In rotating mixers such as, for example, radial turbines, it is within the circular area defined by the tips of the blades. The dispersion area is within the entire cross-section of the reactor in the invention, as is evident from the more detailed description of the invention which follows.

In the method of the invention, gas is directed into the reactor primarily from above, via a hollow gas-feeding conduit to the lower part of the reactor, to the center point of its cross-section, where there is one dispersing member. The gas flow discharging through a flexible dispersing member, which constitutes in the simplest case, a rubber hose attached to the lower end of the conduit causes the dispersing member to move into a flexible movement in which the radius of curvature of the dispersing member decreases continuously towards the trailing end and produces a sharp movement in said dispersing member, which can be described by the term whiplike. When discharging via the open end of the resilient dispersing member, the gas jet produces a reaction force in the dispersing member which enhances the rapid, threedimensional movement of said member.

As is evident from the foregoing description, the invention meets all the previously mentioned requirements of good dispersing of a gas, which known devices meet only in part; gas velocity, which is the advantage of nozzles, flexible movement of the end of the dispersing member, which corresponds to the rapid movement which is the advantage of a mixer, and furthermore, the movement of the dispersing member, which changes place randomly and continuously, so that fresh gas comes into contact with fresh suspension of a solid and a solution.

When the flexible dispersing member thus rotates effectively in a liquid, it produces mechanical mixing, which is due not only to the gas jet discharging from the end of the dispersing member, but also from the winding motion of said flexible member. These two mixing effects put the pulverulent solid particles in the liquid into motion and also maintain the formed suspension within the area of influence of the dispersing members.

The gas bubble groups discharging and dispersing from the dispersing member at different points of the reactor cause, when rising, vertical solution flows in the reactor itself. These vertical flows continue in the lower part of the reactor to maintain the good solid-liquid suspension produced by the flexible dispersing member of the invention.

In addition to the physical phenomena, that is, dispersion and the formation and maintenance of the suspension, there may also continuously occur in the reactor chemical reactions as a result of which gas and solid dissolve in the liquid, and thereby a solution suspension is formed in which the solid is partly in suspension, partly in solution.

The advantages of the method are based on the fact that the flexible dispersing member such as, for example a hose, behaves like a water hose wich has become loose. In such case, advantage is taken of the disadvantageous random movements, the free end of the hose moving in a whip-like manner when the operation is within a certain discharge rate range. In other words, the free end of a dispersing member attached in a certain manner close to the reactor bottom moves randomly along the bottom of the reactor because of the recoil force of the impulse of the gas jet discharging from the end of the said dispersing member at the design rate, influencing said dispersing member. The movement may be controlled, depending upon the flexibility and other similar properties of the dispersing member. While the end of the dispersing member rotates in the reactor, it always distributes the discharging air bubbles at different points within the cross-sectional area of the reactor, whereby highly turbulent flow fields are formed in the solution suspension, the flow fields promoting diffusion and other similar reactions. The flow can never standardize as it does, for example, at nozzles, and therefore the velocity difference required by the reactions is maintained.

When the free end of the dispersing member moves randomly on the reactor bottom, producing by means of its jets force fields which bring the pulverulent solid particles into motion, the part between the free end and the point of attachment moves on the bottom or in its immediate vicinity, thus mechanically cleaning the bottom of accumulations of the solid.

If the cross-sectional area of the reactor is so large that it is not possible to take care of it using one dispersing member, several dispersing members may be used. This is accomplished by utilizing an arrangement which covers the cross-sectional area geometrically, in which arrangement each dispersing member has its own, more or less circular area of operation, which is, of course, dependent on, for example, the length of the dispersing member.

If desired, it is also possible to use baffles on the reactor walls in the reactor, but they are by no means indispensable.

The bottom of the reactor can be curved, of the pressure-vessel type, or the reactor can advantageously be flat-bottomed. The dispersing member cannot operate without hindrance in a reactor having a conical bottom.

DESCRIPTION OF THE DRAWINGS

In order that the invention may be readily carried into effect, it will now be described with reference to the accompanying drawings, wherein.

DESCRIPTION OF THE PREFERRED EMBODIMENTS

Figure 1:
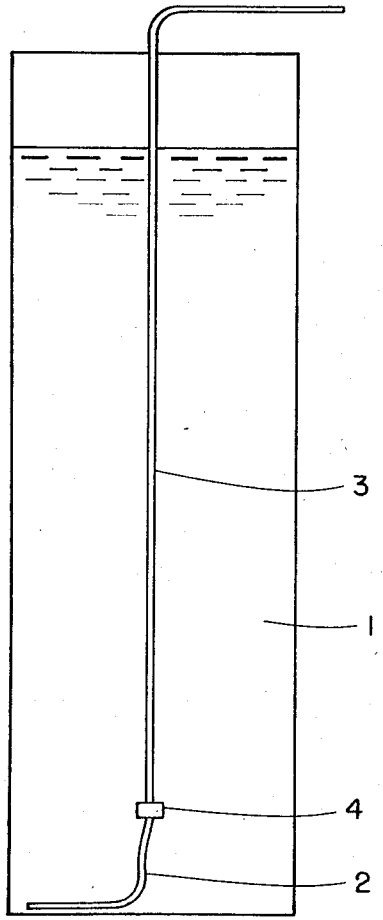
FIG. 1 is a schematic diagram, in vertical section, of a reactor having a dispersing member of the invention therein.

FIG. 1 shows a reactor 1 with a dispersing member 2 in its lower part. The dispersing member 2, which is a tube or hose, is affixed to a gas-feeding pipe 3 at a point 4.

Figure 2:
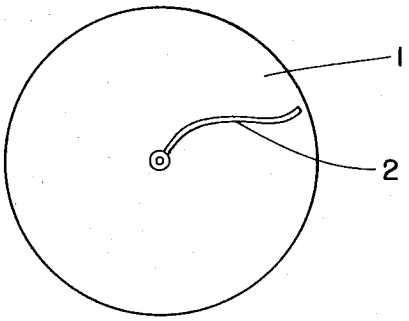
FIG. 2 is a cross-sectional view of the reactor of FIG. 1.

FIG. 2 depicts a case in which one dispersing member 2 is capable of causing the solid to remain in suspension in a liquid over the entire cross sectional area of the reactor.

Figure 3:
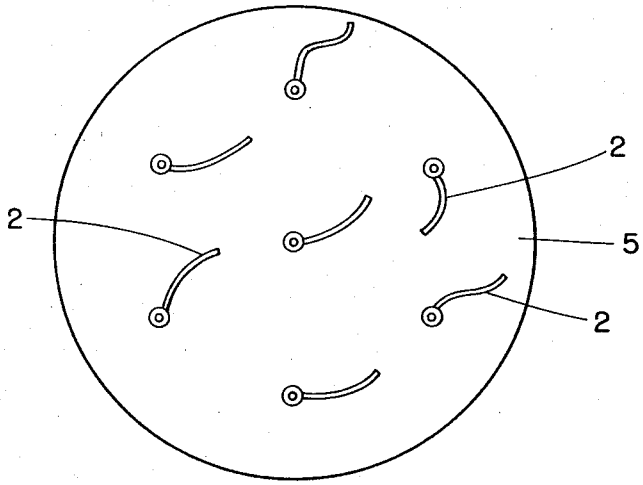
FIG. 3 is a cross-sectional view, on an enlarged scale, of a reactor utilizing a plurality of dispersing members of the invention.

In the embodiment of FIG. 3, the mixing and dispersion in a reactor 5 is accomplished by a purality of dispersing members 2.

The attachment 4 of the dispersing member 2 to the gas-feeding pipe 3 can be rigid, in which case one end of the hose serving as said member is attached to a rigid gas-feeding conduit extending to the lower part of the reactor. The attachment can also be flexible, in which case a flexible member, such as, for example a flexible hose, is attached to the gas-feeding conduit 3, and the lower end of said member is steadied by, for example, a weight in the lower part of the reactor, and the dispersing member 2 is attached to the lower end of said hose.

It has been observed in experiments that the minimum distance of the attachment point of the hose depends upon, for example, the bending properties of said hose.

It has been observed that at its shortest this minimum distance is about 20 % of the hose length.

The advantages of the invention are as follows.

Compared with nozzles, the number of hoses to be used is small. In experiments, it was possible, for example, to take care of a reactor of about 2 $m^2$ by utilizing one hose. The results are improved over those obtained using nozzles. At the same time, the problem of even distribution of gas, known to be difficult, is eliminated.

The mixing mechanism affixed via a shaft from the liquid surface of the reactor to the bottom such as, for example, a turbine, with the gas-feeding devices installed in it such as, for example, a pipe under the propeller, are less advantageous in terms of both investment and their complicated nature.

There is no clogging of the dispersing members as there is when nozzles are used.

It is easy to raise the dispersing members and maintain them, when necessary.

Spare parts maintenance is excellent.

The method of the invention is simple, but effective.

The method of the invention is specifically suitable for a high concentration of solid.

Installation is very simple.

The investment is small, and the method can be easily applied to reactors already in use.

The invention is further described with the aid of the accompanying examples:

EXAMPLE 1

During the first stage, 31 nozzles were installed like a grating on the reactor bottom in order to disperse the solution. The height of the reactor was 5650 mm and its diameter was 1560 mm. The concentration of solid in the solution was 50% by weight. After the experiments, the nozzles were replaced by a dispersing member of the invention. Regarding this alternative, it was observed that chemically the system functioned well, and the mixing properties of the hose used as a dispersing member were better than those of the nozzle grating. The concentration of solid in the solution and possible deposits on the bottom were observed, and it was noted that no deposits were formed and that the solid remained in good suspension in the liquid.

Different hose types were also experimented with in the reactor. It was noted that one hose material functioned well and lasted until the end of the experiment, for about 2 months, and was still usable thereafter. The hose made of another material lasted in use for only one day. The suitable flexibility of the hose was one crucial factor; some types used in the experiments were so rigid that the whip-like movement crucial for good mixing was not produced.

Experiments on the behavior of hoses were also carried out in a reactor having a height of 30 m. Under these conditions it is no longer possible to use a mixer operating at the end of a shaft. In experiments carried out it was observed that a hose may also be used under these conditions and the solid may be caused to remain in suspension with liquid and gas.

EXAMPLE 2

It was desired, by means of the experiments, to test the use of different nozzles and disadvantages at the end of a dispersing member and to determine their advantages and disadvantages. The dispersing member used in the experiment was a suction hose having a diameter of 5/15 mm.

Air was directed into the dispersing member from a fixed air-feeding conduit above the reactor to below the liquid surface via a flexible plastic hose having at its lower end a weight of 0.5 kg and the actual dispersing member. The following observed results were obtained using the same amount of air with nozzles of various sizes or with only a hose without a nozzle.

| Nozzle Diameter in/mm | Movement |
|---|---|
| 1.5 | hose did not move |
| 2.1 | weak movement of hose |
| 2.9 | slow and wide movement of hose |
| no nozzle | whip-like, rapid and wide movement of hose |

It was observed that the addition of a nozzle to the end of the hose increased the pressure inside the hose in relation to the ambient pressure, in which case the rigidity of the hose increased. In addition, a long nozzle prevents the continuous decreasing of the curvature of the flexible hose, and thereby the whip-like character of the movement ceases.

When the end of the hose used as the dispersing member was closed and a discharge outlet was made on the hose side at its trailing end, and compressed air was directed via the hose, the hose wound around its attachment shaft.

EXAMPLE 3

The experiment was to study the ability of the dispersing member to function in a situation in which solid has not remained in suspension in the liquid, but has settled on the bottom of the reactor. The ability of the device to continuously maintain the solid in suspension was also studied.

The diameter of the reactor was 1100 mm, and the diameter of the hose used as the dispersing member was 4/7 mm and its length was 650 mm.

During the first stage, an even, 5 mm high layer of chromite sand was spread on the bottom of the reactor. The amount of air used in the experiment was $V_n = 17.8$ $m^3/h$.

A clean area having a diameter of 700 mm was obtained in the center by the hose. The liquid was water.

In the second experiment, chromite sand was gathered at the center into a heap 120 mm high, and the hose was immersed under the sand. This corresponds in practice to a situation prevailing after, for example, a power blackout. The amount of air used was $V_n = 17.8$ $m^3/h$. The hose got free 8 min after the start and the center of the bottom was free 24 min after the start. When the experiment was repeated without immersing the hose under the pile, the center was free in 18 min.

The chromite sand was piled at a distance of 180 mm from the sides of the reactor into a pile 120 mm high, and the hose was immersed under the pile. The hose got free in 5 min and the center of the bottom was free in 12 min. When the hose was not immersed, the center was free in 15 min.

In all the cases, the chromite sand which had risen from the bottom remained in suspension with water and air.

What is claimed is:

1. A method for dispersing a gas into a liquid in a reactor, forming a good suspension of the three phases of said gas, said liquid and a pulverulent solid in the liquid and for maintaining the achieved good suspension in the reactor, said method comprising directing a gas jet below the surface of the liquid which contains said solid, by means of at least one flexible-structured dispersing member, said member having solid, imperforate walls with an outlet opening solely at its outermost end, the support point of the dispersing member being above the dispersing member at the bottom of the reactor and at the center point of its operating area, the full gas jet under pressure being dicharged freely from the outermost end of the dispersing member, changing its direction randomly whereby the dispersing member exerts a whip-like, repeating movement at the bottom of the reactor, which movement has a continuously decreasing radius of curvature, at the same time causing strong mechanical mixing and thereby producing a good suspension of the three different phases over the entire cross-sectional area of the reactor.

2. A method according to claim 1, in which the suspension of the three different phases is maintained in the reactor by means of several dispersing members.

3. A method according to claim 1, in which the dispersing member used is a flexible hose.

4. A method according to claim 1, in which gas under pressure is introduced from a feeding conduit and gas under pressure is directed into the dispersing member from the said gas-feeding conduit via a flexible member which is steadied by means of a weight in the lower part of the reactor.

5. A method according to claim 1, in which the gas under pressure is directed into the dispersing member via a rigid gas-inlet conduit extending to the lower part of the reactor.

6. A method according to claim 1, in which the distance of the support point of the dispersing member from the bottom is at minimum 20% of the length of the dispersing member.

* * * * *